US006554869B2

(12) United States Patent
Aubay et al.

(10) Patent No.: US 6,554,869 B2
(45) Date of Patent: Apr. 29, 2003

(54) POLYMERS FOR LAUNDRY APPLICATIONS

(75) Inventors: Eric Aubay, Le Perreux sur Marne (FR); Wilfried Blokzijl, Wirral (GB); Cedric Geffroy, Paris (FR); Khalid Mahmood, Wirral (GB); Laurence Griffith Thompson, Wirral (GB); John Michael Walsh, Wirral (GB); Kenneth Wong, Paris (FR); Dominic Yeung, Ontario (CA)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 76 days.

(21) Appl. No.: 09/776,074

(22) Filed: Feb. 2, 2001

(65) Prior Publication Data

US 2002/0052304 A1 May 2, 2002

(30) Foreign Application Priority Data

Feb. 2, 2000 (EP) ..... 00400282

(51) Int. Cl.[7] ..... D06L 1/00; C11D 1/62; C11D 3/37

(52) U.S. Cl. ..... 8/137; 510/330; 510/361; 510/434; 510/476; 510/480; 510/504; 134/39; 134/40; 134/42

(58) Field of Search ..... 510/330, 361, 510/434, 476, 480, 504; 8/137; 134/39, 40, 42

(56) References Cited

U.S. PATENT DOCUMENTS

| | | | | |
|---|---|---|---|---|
| 3,749,682 A | | 7/1973 | Tanner | 252/524 |
| 4,814,101 A | * | 3/1989 | Schieferstein et al. | 252/174.23 |
| 5,413,731 A | | 5/1995 | Adler et al. | 252/174.24 |
| 5,783,533 A | * | 7/1998 | Kenischer et al. | 510/119 |

FOREIGN PATENT DOCUMENTS

| | | | | |
|---|---|---|---|---|
| DE | 196 49 288 | | 6/1998 | |
| DE | 19649288 | * | 6/1998 | C11D/3/37 |
| EP | 995 791 | | 4/2000 | |
| GB | 2 104 091 | | 3/1983 | |
| GB | 2104091 | * | 3/1983 | C11D/3/37 |
| JP | 59/135293 | | 8/1984 | C11D/3/37 |
| JP | 11 193 314 A | | 7/1999 | |
| WO | 97/42285 | | 11/1997 | |
| WO | 98/16538 | | 4/1998 | |
| WO | 98/23714 | | 6/1998 | |
| WO | WO 98/44012 | * | 10/1998 | C08F/220/06 |
| WO | WO 99/24004 | * | 5/1999 | A61K/7/06 |

OTHER PUBLICATIONS

PCT International Search Report in a PCT/EP application PCT/EP 01/00409 Aug. 9, 2001.

Derwent Abstract of JP 59/135 293—published Aug. 3, 1984.

* cited by examiner

*Primary Examiner*—Mark Kopec
*Assistant Examiner*—Brian P. Mruk
(74) *Attorney, Agent, or Firm*—Rimma Mitelman

(57) ABSTRACT

A polymer for use in a composition or method of laundry treatment is a copolymer of:

(a) one or more anionic monomer units;

(b) one or more cationic monomer units; and (c) optionally, one or more uncharged monomer units;

wherein, the number ratio of the total of all negative charges on the anionic monomer unit(s) to the total of all positive charges on the cationic monomer unit(s) is from 10:1 to 3:1, especially from 17:3 to 3:1.

16 Claims, No Drawings

POLYMERS FOR LAUNDRY APPLICATIONS

FIELD OF INVENTION

The present invention relates to polymers which are used in laundry cleaning products, e.g. for incorporation in products for dosing in the wash and/or rinse. They are intended for, but not limited to, soil release benefits in such products.

BACKGROUND OF THE INVENTION

The term "soil release polymer" is used in the art to cover polymeric materials which assist release of soil from fabrics, e.g. cotton or polyester based fabrics. For example, it is used in relation to polymers which assist release of soil direct from fibers. It is also used to refer to polymers which modify the fibers so that dirt adheres to the polymer-modified fibers rather than to the fiber material itself Then, when the fabric is washed the next time, the dirt is more easily removed than if it was adhering the fibers. Although not wishing to be bound by any particular theory or explanation, the inventors believe that the soil release polymers utilised in the present invention probably exert their effect mainly by the latter mechanism.

WO-A-98/23714 discloses water-soluble use of nitrogen-containing soil-release polymers in detergent products. Some of these polymers are formed from acrylamide monomers polymerised with co-monomers which are amines of alkylacrylates. These materials are essentially neutral, i.e. have no substantial overall positive or negative charge. Thus, they are suited to soil release from polyester rather than from cotton.

Another type of nitrogen-containing soil release polymer described in WO-A-98/23714 is formed from dicarboxylic acid monomers and hydrophilic co-monomers which are secondary amines which contain (poly)alkyleneoxy groups. Since these molecules do not have an overall net positive charge, they are also non-substantive to cotton.

A third type of nitrogen-containing soil-release polymer disclosed in WO-A-98/23714 is formed from alkyleneacrylate monomers having a terminal quaternary ammonium group and co-monomers which are (meth)acrylic acid or esters or salts thereof Therefore, such a polymer may have both cationic and anionic groups. Only a single example of such a material is given. This is polymer formed from a cationic monomer, namely methacrylamidopropyl trimethylammonium chloride (MAPTAC), and anionic monomer, namely acrylic acid (AA) and a neutral monomer, namely isobutylacrylate (IsoBuA). These particular cationic and anionic monomers carry, respectively, a single positive and negative charge. However, this particular kind of polymer has proved to be not very suited to soil release.

U.S. Pat. No. 3,749,682 discloses copolymers of polyvinylpyrrodinone (PVP) and vinyl acetate for use as soil anti-redeposition agents.

WO-A-97/42285 discloses cotton soil-release polymers comprising a polyamine backbone and quaternary ammonium cationic groups. However, the present applicants have found that whilst cationic groups give good substantivity to cotton, a high density of cationic positive charges on the polymer gives rise to staining of the fabric.

EP-A-0995791 discloses a broad range of hydrophobically modified polycarboxylate polymers which are said to be useful for promoting soil release from fabrics, particularly cotton and cotton-containing fabrics. The polymers can comprise up to three moieties A, B and C wherein A is a polymerised residue of a monomer selected from one or more $C_3$–$C_8$ monoethylenically unsaturated carboxylic acids, B is a polymerised residue of a monomer slected from one or more $C_3$–$C_{60}$ alkyl (meth)acrylates, ethoxylated $C_1$–$C_{24}$ alkyl (meth)acrylates, and poly(alkylene glycol) (meth)acrylates, alkyl or aromatic ethers of poly(alkylene glycol) and the corresponding maleate mono and di-esters thereof, and C is a polymerised residue of a monomer selected from one or more ethylenically unsaturated monomers which are copolymerisable with the monomers in A and B. However, only two specific examples are given which contain both anionic and cationic groups. One such polymer is formed from an anionic monomer, namely acrylic acid (AA), a cationic monomer, namely dialkyldimethyl ammonium chloride (DADMAC), and lauryl ($C_{12}$) methacrylate ethoxylated with 4 moles of ethylene oxide (E4LMA) whereas the other polymer is formed from AA, E4LMA and [2-(methacryloyloxy)ethyl]trimethyl ammonium chloride (MAETMAC) as a cationic monomer. These particular anionic and cationic monomers carry, respectively, a single negative and positive charge. However, it is clear from the examples in question that the number ratio of anionic: cationic charges is >50:1.

According to GB-A-2 104 091, copolymers of anionic and cationic vinyl monomers can be used as detergency builders, for a wide range of detergent products, e.g. for warewashing, hard surface cleaning, textile cleaning and hair products. However, there is no disclosure that these materials are capable of acting as soil-release polymers. They are not well suited to soil release from cotton and can lead to significant staining. Although a wide range of anionic: cationic mole ratios is claimed (from 1:99 to 99:1), in all of the examples, the number ratio of anionic (negative):cationic (positive) charges is 1:1, which again, is not suited to providing the cotton substantivity required of a cotton soil-release polymer.

U.S. Pat. No. 5,783,533 discloses various amphoteric copolymers as Theological modifiers of lamellar phases of detergent or cosmetic compositions. However, there is no disclosure that these materials are capable of acting as soil-release polymers.

JP-A-59135293 discloses detergent compositions which contain an amphoteric copolymer consisting of at least 10 mol % cationic vinyl monomer units, at least 10 mol % anionic vinyl monomer units and at least 10 mol % nonionic vinyl monomer units. The preferred proportion of cationic vinyl monomer units to anionic vinyl monomer units by molar ratio from 1:2 to 2:1. However, there is no disclosure that these materials are capable of acting as soil-release polymers.

U.S. Pat. No. 5,413,731 discloses water-soluble terpolymers which are useful in automatic machine dishwashing detergent formulations. These terpolymers contain as polymerised units (a) from about 92 to about 30% by weight of one or more $C_3$–$C_6$ monoethylenically unsaturated carboxylic acids, (b) from about 5 to about 50% by weight of one or more aminoacryloyl derivatives, and (c) from about 25% by weight of one or more monoethylenically unsaturated monomers polymerisable with (a) and (b). However, there is no disclosure that these materials could be utilised in a composition for washing and/or rinsing landry, nor any suggestions that these terpolymers could act as soil-release polymers.

Thus, there remains a need to obtain soil release in laundry products based on soil-release agents which are copolymers of cationic and anionic monomers, give better substantivity to cotton and therefore, better soil release from cotton fabrics, fewer or no detrimental interactions with LAS or other anionic surfactants, as well as less staining negatives.

DEFINITION OF THE INVENTION

A composition for washing and/or rinsing of laundry, the composition comprising one or more surfactants suitable for use in laundry wash and/or rinsing products and a polymer which is a co-polymer formed of:

(a) one or more anionic monomer units;

(b) one or more cationic monomer units; and (c) optionally, one or more neutral (uncharged) monomer units;

wherein, the number ratio of the total of all negative charges on the anionic monomer unit(s) to the total of all positive charges on the cationic monomer unit(s) is from 10:1 to 3:1, preferably from 8:1 to 3:1, especially from 17:3 to 3:1.

The applicants have found that these charge ratios (progressively) give the optimum balance of soil release performance with avoidance of staining and detrimental interactions with the LAS or other anionic surfactants.

A second aspect of the invention provides use of a polymer for a method effecting soil-release of a laundry item, the method comprising contacting the laundry item with the said polymer, the polymer being a copolymer formed of:

(a) one or more anionic monomer units;

(b) one or more cationic monomer units; and (c) optionally, one or more uncharged monomer units;

wherein, the number ratio of the total of all negative charges on the anionic monomer unit(s) to the total of all positive charges on the cationic monomer unit(s) is from 10:1 to 3:1, preferably from 8:1 to 3:1, especially from 17:3 to 3:1.

This aspect of the invention may also be expressed as a process for effecting soil release from a laundry item, said process comprising contacting the laundry item with the said polymer, the polymer being a copolymer formed of:

(a) one or more anionic monomer units;

(b) one or more cationic monomer units; and (c) optionally, one or more uncharged monomer units;

wherein, the number ratio of the total of all negative charges on the anionic monomer unit(s) to the total of all positive charges on the cationic monomer unit(s) is from 10:1 to 3:1, preferably from 8:1 to 3:1, especially from 17:3 to 3:1.

DETAILED DESCRIPTION OF THE INVENTION

The Polymer

The polymer is a co-polymer containing one or more anionic monomer units, one or more cationic monomer units and optionally, one or more uncharged monomer units.

Preferably, the polymer has a weight average molecular weight of from 500 or from 1,000 to 1,000,000 or to 500,000, more preferably from 50,000 to 250,000 as determined by the methods of viscosity measurement and GPC using a polyethyleneoxide as standard.

The anionic monomer unit(s) (a) is/are preferably selected from one or more units derived from ethylenically unsaturated monomers having at least one anionic group. Typical such monomers have the general formula (A)

(A)

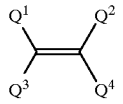

wherein at least two of $Q^1$–$Q^4$ are independently selected from hydrogen and methyl; either one or two of $Q^1$—$Q^4$ are independently selected from anionic groups, preferably of formula:

$$—Q^5—Q^6—Y$$

wherein either or both of $Q^5$ and $Q^6$ is/are absent, $Q^5$ otherwise representing —Ph—, —CO—, —$CH_2$=$CH_2$, —CONH— or —CO—O— and $Q^6$ otherwise representing a $C_{1-4}$ alkylene linkage, one or more of the hydrogen atoms of which is independently optionally substituted by an —OH group or a group —Y;

Y is selected from groups of formula —$CO_2H$, —$SO_3H$, —$OSO_3H$ —$PO_4H$ —$PO_3H$, —$OPO_3H_2$ and —$OPO_3H_3$;

and in the case where two only of $Q^1$-$Q^4$ are independently hydrogen or methyl and only one of $Q^1$-$Q^4$ is $Q^5$-$Q^6$-Y. then the remaining group of $Q^1$-$Q^4$ can be any other compatible uncharged group, for example aliphatic, aromatic or mixed aliphatic-aromatic groups having from 2 to 20 carbon atoms (optionally also containing one or more heteroatoms) such as $C_{2-20}$ alkyl groups, $C_{5-12}$ cycloalkyl groups, $C_{5-9}$ aryl groups, $C_{1-8}$ alkyl-$C_{5-9}$ aryl groups, any cycloalkyl or aryl group optionally containing one or two heteroatoms independently selected from nitrogen, oxygen and sulphur.

Preferred anionic groups for the anionic monomer units (whether or not derived from monomers of formula (A)) are selected from —$CO_2H$, —$SO_3H$, —$OSO_3H$, —$CH_2OSO_3H$, —CH=$CHSO_3H$ and groups of formula —$(CO)_p$—$CH_2$—$CQ^7Q^8CO_2H$ —$PO_4H$ —$PO_3H$, —$OPO_3H_2$, —$OPO_3H_3$, wherein p is 0 or 1, $Q^7$ is selected from H and OH and $Q^8$ is selected from H and $CO_2H$; and salts thereof A non-limiting list of suitable ethylenically unsaturated anionic monomers includes acrylic acid, methacrylic acid, α-ethacrylic acid, β,β-dimethylacrylic acid, methylenemalonic acid, vinylacetic acid, allylacetic acid, ethylideneacetic acid, propylideneacetic acid, crotonic acid, maleic acid or anhydride, fumaric acid, itaconic acid, citraconic acid, mesaconic acid, N-(methacryloyl)alanine, N-(acryloyl)-hydroxyglycine, sulphopropyl acrylate, sulphoethyl acrylate, sulphoethyl methacrylate, styrenesulphonic acid, vinylsulphonic acid, 2-sulphoethyl methacrylate, sodium allyloxy hydrooxypropyl sulphonate, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate, phophonopropyl methacrylate, ethyleneglycol methacrylate phophate, sulphate of alkoxylate (meth) acrylate, and salts thereof.

Any reference herein to an alkyl group on its own or as part of another group includes reference to straight and branched forms thereof.

Any anionic group forming part of an anionic monomer starting material or anionic monomer unit of the polymer may be in the acid form or salt form. Often, the free acid form may be neutralised either as part of the process for forming the polymer or when the polymer is incorporated in the detergent composition. Suitable counter-cations of the salt forms are alkali metals such as sodium or potassium, alkaline earth metals such as magnesium or organic ions such as $NH_4^+$.

The monomer unit(s) (b) are preferably derived from ethylenically unsaturated monomers and advantageously comprise at least one quaternary ammonium group. Preferably they are selected from the units derived from compounds of following general formulae (I) to (III):

(I)

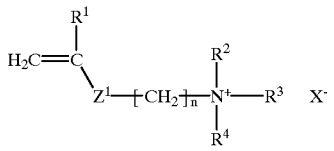

in which:

$R^1$ is a hydrogen atom or a methyl group, preferably a methyl group;

$R^2$, $R^3$ and $R^4$ are linear or branched $C_1$–$C_6$ alkyl groups;

n is from 1 to 4, in particular the number 3;

$Z^1$ is a group —C(O)O, —C(O)NH— or —O—; and $X^-$ is a counterion compatible with the water-soluble nature of the polymer;

(II)

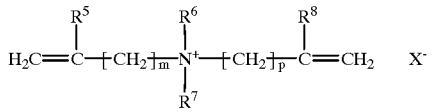

in which:

$R^5$ and $R^8$ are, independently hydrogen, or a linear or branched $C_1$–$C_6$ alkyl group;

$R^6$ and $R^7$ are independently represent alkyl, hydroxyalkyl or aminoalkyl group in which the alkyl group is a linear or branched $C_1$–$C_6$ chain, preferably a methyl group;

m and p are independently from 1 to 3; and $X^-$ is as defined in formula (I); and (III)

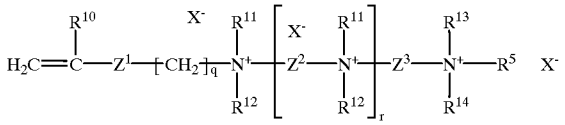

in which:

$R^9$ is hydrogen, methyl or ethyl;

$R^{10}$, $R^{11}$, $R^{12}$, $R^{13}$ and $R^{14}$ independently selected from groups as defined for $R^6$ and $R^7$ in formula(II);

q is from 0 to 10, preferably from 0 to 2;

r is from 0 to 6, preferably from 1 to 6, more preferably from 2 to 4;

$Z^1$ is as defined in formula (I);

$Z^2$ represents a $(CH_2)s$ group, s being from 1 to 6, preferably from 2 to 4;

$Z^3$ is a linear or branched $C_2$–$C_{12}$, advantageously $C_3$–$C_6$, polymethylene chain optionally interrupted by one or more heteroatoms or heterogroups, in particular O or NH, and optionally substituted by one or more hydroxyl or amino groups, preferably hydroxyl groups; and $X^-$, is as defined in formula (I); and and also from ethylenically unsaturated monomers containing an aliphatic or aromatic cyclic moiety which contains a charged nitrogen ($N^+$) atom.

Preferred monomers of formula (I) are those of (IV):

(IV)

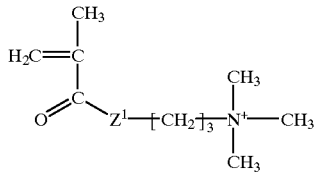

wherein $Z^1$ is as defined in formula(I), especially that where $Z^1$ is —NH— and the counterion is a chloride (MAPTAC).

A preferred monomer of formula (II), is:

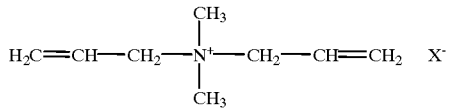

in which X is a chloride (DADMAC).

Preferred monomers of formula (III) are those wherein:

q is 2 or 3, especially 3;

r is from 0 to 2, more preferably 0 to 1, especially 0;

$Z^3$ is

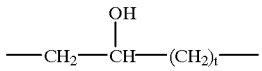

where t is from 1 to 4, preferably 1, and $R^{10}$ to $R^{14}$ which are the same or different, and represent a methyl or ethyl group.

Particularly preferred monomers (b) of the latter type are those of following formula:

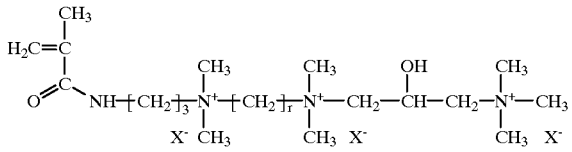

wherein r is from 2 to 4, and more particularly the monomer

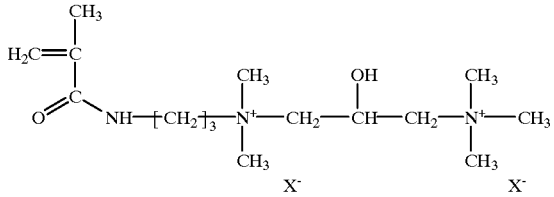

X– representing the chloride ion (Diquat)

When one or more uncharged monomer units (c) are also incorporated in the polymer, they are in a mole ratio of total uncharged units relative to the total of all anionic monomer units plus the total of all cationic monomer units of from 99:1 to 0:100, more preferably from 5:1 to 0:1. In another preferred embodiment, the mole ratio of the unchanged units relative to the total of all anionic monomer units plus the total of all cationic monomer units is from 1:1 to 1:99, preferably from 3:2 to 1:9.

Preferably, the uncharged monomer units are derived from ethyenically unsaturated monomers, suitably selected from one or more of the following types (i)–(iii):

(i) hydrophilic neutral monomers such as (meth) acrylamide and their N-monosubstituted or N,N-disubstituted versions. (such as N-isopropylacrylamide, N-butylacrylamide and N,N-dimethylacrylamide), vinyl formamide, vinyl pyrrolidone, alkoxylated (meth)acrylate, such as hydroxyethyl(meth)acrylate, hydroxypropyl(meth) acrylate, and their higher ethoxylated or propoxylated versions such as behenyl polyethoxy methacrylate, e.g. sold as Sipomer BEM ex Rhodia, of the formula (V):

(V)

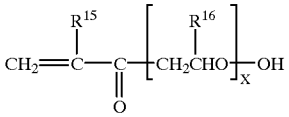

wherein $R^{15}$ is hydrogen, or methyl and $R^{16}$ is hydrogen, methyl or ethyl, and X is from 1 to 150;

(ii) hydrophobic neutral monomers such as vinyl actate and its higher homologs, alkyl(meth)acrylates (e.g. methyl methacrylate, butyl acrylate and ethyl acrylate), styrene and its derivatives, methyl vinyl ether, Sipomer WAM and WAM II from Rhodia, glycidyl methacrylate, and many commercial speciality monomers used in conventional latexes (e.g. AAEM, other from DGY). Of the above mentioned monomers, those which are hydrolysable in the wash medium are especially preferred (e.g. vinyl acetate and its derivates)

(iii) hydrophilic neutral with potentially cationic functional groups. The said functional groups have a pK lower than 12 preferably between 5 to 11 and most preferably between 6 to 10. The monomers above which comprise an amino group are especially preferred. The most preferred uncharged monomers are of formula (VI):

(VI)

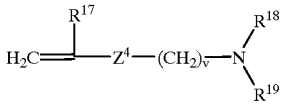

wherein $R^{17}$ is hydrogen or $C_1$ to $C_6$ alkyl, $Z^4$ is O (ether linkage), $CO_2$ (ester), or CONH (amide), $R^{18}$ and $R^{19}$ are independently hydrogen, $C_1$ to $C_{10}$ with OH and/or $NH_2$ groups at the end or any position along this alkyl chain, and v is from 1 to 6.

Typical suitable such uncharged monomer units independently may be selected as one or more of the optional uncharged monomer unit(s) denoted by formula (m).

Synthesis of the Polymer

The polymer used in the present invention is preferably obtained from respective monomers corresponding to anionic monomer units (a), cationic monomer units (b) and optionally, neutral (uncharged) monomer units (c), each respectively being ethylenically unsaturated. The different available means of copolymerising such ethylenically unsaturated monomers will be well known to those skilled in the art of polymer chemistry. Depending on the order of addition of reactants, the resulting polymers may be block, random or mixed block/random copolymers.

Surfactants

Compositions according to the first aspect of the invention must also comprise one or more surfactants suitable for use in laundry wash and/or rinsing products. In the most general sense, these may be chosen from one or more of soap and non-soap anionic, cationic, nonionic, amphoteric and zwitterionic surface-active compounds and mixtures thereof. Many suitable surface-active compounds are available and are fully described in the literature, for example, in "Surface-Active Agents and Detergents" , Volumes I and II, by Schwartz, Perry and Berch.

For those compositions intended as laundry wash products, preferably, the surfactant(s) is/are selected from one or more soaps and synthetic non-soap anionic and non-ionic compounds. Detergent compositions suitable for use in most automatic fabric washing machines generally contain anionic non-soap surfactant, or non-ionic surfactant, or combinations of the two in any suitable ratio, optionally together with soap.

For example, laundry wash compositions of the invention may contain linear alkylbenzene sulphonate anionic surfactants, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The laundry wash compositions of the invention may additionally or alternatively contain one or more other anionic surfactants in total amounts corresponding to percentages quoted above for alkyl benzene sulphonates. Suitable anionic surfactants are well-known to those skilled in the art. These include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Some particular examples of such other anionic surfactants are:

alkyl ester sulphonates of the formula R—CH($SO_3$M)—COOR', where R is a $C_8$-$C_{20}$, preferably $C_{10}$-$C_{16}$ alkyl radical, R' is a $C_1$–$C_{16}$, preferably $C_1$–$C_3$ alkyl radical, and M is an alkaline cation (sodium, potassium, lithium), substituted or non-substituted ammonium (methyl, dimethyl, trimethyl, tetramethyl ammonium, dimethyl piperidinium, etc.) or a derivative of an alkanol amine (monoethanol amine, diethanol amine, triethanol amine, etc.);

alkyl sulphates of the formula R$OSO_3$M, where R is a $C_5$–$C_{24}$, preferably $C_{10}$–$C_{18}$ alkyl or hydroxyalkyl radical, and M is a hydrogen atom or a cation as defined above, and their ethyleneoxy (EO) and/or propyleneoxy (PO) derivatives, having on average 0.5 to 30, preferably 0.5 to 10 EO and/or PO units;

alkyl amide sulphates of the formula RCONHR'$OSO_3$M, where R is a $C_2$–$C_{22}$, preferably $C_6$–$C_{20}$ alkyl radical, R' is a $C_2$–$C_3$ alkyl radical, and M is a hydrogen atom or a cation as defined above, and their ethyleneoxy (EO) and/or propyleneoxy (PO) derivatives, having on average 0.5 to 60 EO and/or PO units;

the salts of $C_8$–$C_{24}$, preferably $C_{14}$–$C_{20}$ saturated or unsaturated fatty acids, $C_8$–$C_{22}$ primary or secondary alkyl sulphonates, alkyl glycerol sulphonates, the sulphonated polycarboxylic acids described in GB-A-1 082 179, paraffin sulphonates, N-acyl,N'-alkyl taurates, alkyl phosphates, isethionates, alkyl succinamates, alkyl sulphosuccinates, monoesters or diesters of sulphosuccinates, N-acyl sarcosinates, alkyl glycoside sulphates, polyethoxycarboxylates, the cation being an alkali metal (sodium, potassium, lithium), a substituted or non-substituted ammonium residue (methyl, dimethyl, trimethyl, tetramethyl ammonium, dimethyl piperidinium, etc.) or a derivative of an alkanol amine (monoethanol amine, diethanol amine, triethanol amine, etc.);

sophorolipids, such as those in acid or lactone form, derived from 17 -hydroxyoctadecenic acid;

The laundry wash compositions of the invention may contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Some particular examples of such nonionic surfactants are:

polyalkoxylenated alkyl phenols (i.e. polyethyleneoxy, polypropyleneoxy, polybutyleneoxy), the alkyl substituent of which has from 6 to 12 C atoms and contains from 5 to 25 alkoxylenated units; examples are TRITON X-45, X-114, X-100 and X-102 marketed by Rohm & Haas Co., IGEPAL NP2 to NP17 made by Rhodia;

$C_8$–$C_{22}$ polyalkoxylenated aliphatic alcohols containing 1 to 25 alkoxylenated (ethyleneoxy, propyleneoxy) units; examples are TERGITOL 15-S-9, TERGITOL 24-L-6 NMW marketed by Union Carbide Corp., NEODOL 45-9, NEODOL 23-65, NEODOL 45-7, NEODOL 45-4 marketed by Shell Chemical Co., KYRO EOB marketed by The Procter & Gamble Co., SYNPERONIC A3 to A9 made by ICI, RHODASURF IT, DB and B made by Rhodia;

the products resulting from the condensation of ethylene oxide or propylene oxide with propylene glycol, ethylene glycol, with a molecular weight in the order of 2000 to 10,000, such as the PLURONIC products marketed by BASF;

the products resulting from the condensation of ethylene oxide or propylene oxide with ethylene diamine, such as the TETRONIC products marketed by BASF;

$C_8$–$C_{18}$ ethoxyl and/or propoxyl fatty acids containing 5 to 25 ethyleneoxy and/or propyleneoxy units;

$C_8$–$C_{20}$ fatty acid amides containing 5 to 30 ethyleneoxy units;

ethoxylated amines containing 5 to 30 ethyleneoxy units;

alkoxylated amidoamines containing 1 to 50, preferably 1 to 25 and in particular 2 to 20 alkyleneoxy (preferably ethyleneoxy) units;

amine oxides such as the oxides of alkyl $C_{10}$–$C_{18}$ dimethylamines, the oxides of alkoxy $C_8$–$C_{22}$ ethyl dihydroxy ethylamines;

alkoxylated terpene hydrocarbons such as ethoxylated and/or propoxylated α- or β-pinenes, containing 1 to 30 ethyleneoxy and/or propyleneoxy units;

alkylpolyglycosides obtainable by condensation (for example by acid catalysis) of glucose with primary fatty alcohols (e.g. U.S. Pat. No. 3,598,865; U.S. Pat. No. 4,565,647; EP-A-132 043; EP-A-132 046) having a $C_4$–$C_{20}$, preferably $C_8$–$C_{18}$ alkyl group and an average number of glucose units in the order of 0.5 to 3, preferably in the order of 1.1 to 1.8 per mole of alkylpolyglycoside (APG), particularly those having a $C_8$–$C_{14}$ alkyl group and on average 1.4 glucose units per mole a $C_{12}$–$C_{14}$ alkyl group and on average 1.4 glucose units per mole a $C_8$–$C_{14}$ alkyl group and on average 1.5 glucose units per mole a $C_8$–$C_{10}$ alkyl group and on average 1.6 glucose units per mole marketed under the names GLUCOPON 600 EC®, GLUCOPON 600 CSUP®, GLUCOPON 650 EC® and GLUCOPON 225 CSUP® respectively and made by HENKEL;

It is preferred if the level of total non-ionic surfactant is from 0 wt % to 30 wt %, preferably from 1 wt % to 25 wt %, most preferably from 2 wt % to 15 wt % .

Another class of suitable surfactants comprises certain mono-long chain-alkyl cationic surfactants for use in main-wash laundry compositions according to the invention. Cationic surfactants of this type include quaternary ammonium salts of the general formula $R_1R_2R_3R_4N^+ X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$-C14 alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present in the laundry wash compositions according to the invention, will depend on the intended use of the detergent composition. In fabric washing compositions, different surfactant systems may be chosen, as is well known to the skilled formulator, for handwashing products and for products intended for use in different types of washing machine. The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

In the case of laundry rinse compositions according to the invention the surfactant(s) is/are preferably selected from fabric conditioning agents. In fact, conventional fabric conditioning agent may be used. These conditioning agents may be cationic or non-ionic. If the fabric conditioning compound is to be employed in a main wash detergent composition the compound will typically be non-ionic. If used in the rinse phase, they will typically be cationic. They may for example be used in amounts from 0.5% to 35%, preferably from 1% to 30% more preferably from 3% to 25% by weight of the composition.

Preferably the fabric conditioning agent(s) have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric conditioning agents are predominantly linear.

The fabric conditioning agents are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers, D Marsh, CRC Press, Boca Raton, Fla., 1990 (pages 137 and 337).

Substantially insoluble fabric conditioning compounds in the context of this invention are defined as fabric conditioning compounds having a solubility less than $1\times10^{-3}$ wt % in demineralised water at 20° C. Preferably the fabric softening compounds have a solubility less than $1\times10^{-4}$ wt %, most preferably less than $1\times10^{-8}$ to $1\times10^{-6}$. Preferred cationic fabric softening agents comprise a substantially water insoluble quaternary ammonium material comprising a single alkyl or alkenyl long chain having an average chain length greater than or equal to $C_{20}$ or, more preferably, a compound comprising a polar head group and two alkyl or alkenyl chains having an average chain length greater than or equal to $C_{14}$.

Preferably, the cationic fabric softening agent is a quaternary ammonium material or a quaternary ammonium material containing at least one ester group. The quaternary ammonium compounds containing at least one ester group are referred to herein as ester-linked quaternary ammonium compounds.

As used in the context of the quarternary ammonium cationic fabric softening agents, the term 'ester group', includes an ester group which is a linking group in the molecule.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester groups(s) are preferably attached to the nitrogen atom via another hydrocarbyl group.

Also preferred are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

Preferably the quaternary ammonium material is a compound having two $C_{12}$–$C_{22}$ alkyl or alkenyl groups connected to a quaternary ammonium head group via at least one ester link, preferably two ester links or a compound comprising a single long chain with an average chain length equal to or greater than $C_{20}$.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

The most preferred type of ester-linked quaternary ammonium material that can be used in laundry rinse compositions according to the invention is represented by the formula (A):

(A)

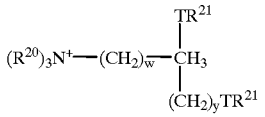

wherein T is

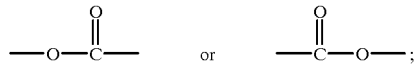

each $R^{20}$ group is independently selected from $C_{1-4}$ alkyl, hydroxyalkyl or $C_{2-4}$ alkenyl groups; and wherein each $R^{21}$ group is independently selected from $C_{8-28}$ alkyl or alkenyl groups; $Y^-$ is any suitable counter-ion, i.e. a halide, acetate or lower alkosulphate ion, such as chloride or methosulphate;

w is an integer from 1–5 or is 0; and y is an integer from 1–5.

It is especially preferred that each $R^{20}$ group is methyl and w is 1 or 2.

It is advantageous for environmental reasons if the quaternary ammonium material is biologically degradable. Preferred materials of this class such as 1,2 bis[hardened tallowoyloxy]-3 -trimethylammonium propane chloride and their method of preparation are, for example, described in U.S. Pat. No. 4,137,180. Preferably these materials comprise small amounts of the corresponding monoester as described in U.S. Pat. No. 4,137,180 for example 1-hardened tallowoyloxy-2-hydroxy-3-trimethylammonium propane chloride.

Another class of preferred ester-linked quaternary ammonium materials for use in laundry rinse compositions according to the invention can be represented by the formula:

(B)

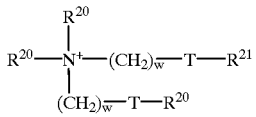

wherein T is

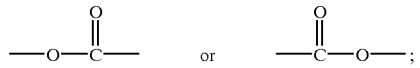

and wherein $R^{20}$, $R^{21}$, and $Y^-$ are as defined above.

Of the compounds of formula (B), di-(tallowyloxyethyl)-dimethyl ammonium chloride, available from Hoechst, is the most preferred. Di-(hardened tallowyloxyethyl)dimethyl ammonium chloride, ex Hoechst and di-(tallowyloxyethyl)-methyl hydroxyethyl methosulphate are also preferred.

Another preferred class of quaternary ammonium cationic fabric softening agent is defined by formula (C):

(C)

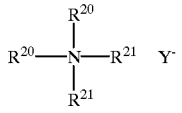

where $R^{20}$, $R^{21}$ and $Y^-$ are as hereinbefore defined.

A preferred material of formula (C) is di-hardened tallow-diethyl ammonium chloride, sold under the Trademark Arquad 2HT.

The optionally ester-linked quaternary ammonium material may contain optional additional components, as known in the art, in particular, low molecular weight solvents, for instance isopropanol and/or ethanol, and co-actives such as nonionic softeners, for example fatty acid or sorbitan esters.

Detergency Builders

The compositions of the invention, when used as laundry wash compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive. Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10wt %.

Builders, both inorganic and organic, are preferably present in alkali metal salt, especially sodium salt, form.

Bleaches

Laundry wash compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernonanoic acid precursors. Especially preferred bleach precursors suitable for use in the present invention are N,N,N',N',-tetracetyl ethylenediamine (TAED) and sodium nonanoyloxybenzene sulphonate (SNOBS). The novel quaternary ammonium and phosphonium bleach precursors disclosed in U.S. Pat. No. 4,751,051 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. examples of such peracids can be found in U.S. Pat. No. 4,686,063 and U.S. Pat. No. 5,397, 501 (Unilever). A preferred example is the imido peroxycarboxylic class of peracids described in EP A 325 288, EP A 349 940, DE 382 3172 and EP 325 289. A particularly preferred example is phthalimido peroxy caproic acid (PAP). Such peracids are suitably present at 0.1–12%, preferably 0.5–10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

Enzymes

Laundry wash compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis,* such as the commercially available subtilisins Maxatase (Trade Mark), as supplied by Gist Brocades N. V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

Other Optional Ingredients

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Yet other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; colored speckles; perfumes; foam controllers; fluorescers and decoupling polymers. This list is not intended to be exhaustive.

It is often advantageous if soil release or soil suspending polymers are present, for example in amounts in the order of 0.01% to 10%, preferably in the order of 0.1% to 5% and in particular in the order of 0.2% to 3% by weight, such as

- cellulose derivatives such as cellulose hydroxyethers, methyl cellulose, ethyl cellulose, hydroxypropyl methyl cellulose, hydroxybutyl methyl cellulose;
- polyvinyl esters grafted onto polyalkylene backbones, such as polyvinyl acetates grafted onto polyoxyethylene backbones (EP-A-219 048);
- polyvinyl alcohols;
- polyester copolymers based on ethylene terephthalate and/or propylene terephthalate units and polyethyleneoxy terephthalate units, with a molar ratio (number of units) of ethylene terephthalate and/or propylene terephthalate/(number of units) polyethyleneoxy terephthalate in the order of 1/10 to 10/1, the polyethyleneoxy terephthalate units having polyethyleneoxy units with a molecular weight in the order of 300 to 10,000, with a molecular weight of the copolyester in the order of 1000 to 100,000;
- polyester copolymers based on ethylene terephthalate and/or propylene terephthalate units and polyethyleneoxy and/or polypropyleneoxy units, with a molar ratio (number of units) of ethylene terephthalate and/or propylene terephthalate/(number of units) polyethyleneoxy and/or polypropyleneoxy in the order of 1/10 to 10/1, the polyethyleneoxy and/or polypropyleneoxy units having a molecular weight in the order of 250 to 10,000, with a molecular weight of the copolyester in the order of 1000 to 100,000 (U.S. Pat. No. 3,959,230, U.S. Pat. No. 3,962,152, U.S. Pat. No. 3,893,929, U.S. Pat. No. 4,116,896, U.S. Pat. No. 4,702,857, U.S. Pat. No. 4,770,666, EP-A-253 567, EP-A-201 124);
- copolymers of ethylene or propylene terephthalate/polyethyleneoxy terephthalate comprising sulphoisophthaloyl units in their chain (U.S. Pat. No. 4,711,730, U.S. Pat. No. 4,702,857, U.S. Pat. No. 4,713,194);
- terephthalic copolyester oligomers having polyalkyleneoxyalkyl sulphonate/sulphoaroyl terminal groups and optionally containing sulphoisophthaloyl units in their chain (U.S. Pat. No. 4,721,580, U.S. Pat. No. 5,415,807, U.S. Pat. No. 4,877,896, U.S. Pat. No.

5,182,043, U.S. Pat. No. 5,599,782, U.S. Pat. No. 4,764,289, EP-A-311 342, WO92/04433, WO97/42293);

sulphonated terephthalic copolyesters with a molecular weight less than 20,000, obtained e.g. from a diester of terephthalic acid, isophthalic acid, a diester of sulphoisophthalic acid and a diol, in particular ethylene glycol (WO95132997);

polyurethane polyesters, obtained by reaction of a polyester with a molecular weight of 300 to 4000, obtained from a terephthalic acid diester, possibly a sulphoisophthalic acid diester and a diol, on a prepolymer with isocyanate terminal groups, obtained from a polyethyleneoxy glycol with a molecular weight of 600 to 4000 and a diisocyanate (U.S. Pat. No. 4,201,824);

sulphonated polyester oligomers obtained by sulphonation of an oligomer derived from ethoxylated allyl alcohol, dimethyl terephthalate and 1,2-propylene diol, having 1 to 4 sulphonate groups (U.S. Pat. No. 4,968,451).

Use

The composition when diluted in the wash liquor (during a typical wash cycle) will typically give a pH of the wash liquor from 7 to 11, preferably from 7 to 10.5, for a wash product. Treatment of a fabric with a soil-release polymer in accordance with the second aspect of the present invention can be made by any suitable method such as washing, soaking or rinsing.

Typically the treatment will involve a washing or rinsing method such as treatment in the main wash or rinse cycle of a washing machine and involves contacting the fabric with an aqueous medium comprising the composition according to the first aspect of the present invention.

Product Form

Compositions according to the first aspect of the present invention may be formulated in any convenient form, for example as powders, liquids (aqueous or non-aqueous) or tablets.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

The present invention will now be explained in more detail by way of the following non-limiting examples.

EXAMPLES

The following evaluation experiments were carried-out using base formulations of detergent powders as follows (hereinafter called "Composition A" and "Composition B").

| | wt % |
|---|---|
| Composition A | |
| LAS[1] | 24.0 |
| STPP[2] | 14.5 |
| Sodium silicate | 7.0 |
| Sodium sulphate | 17.7 |
| Sodium perborate | 8.0 |
| TAED[3] | 2.4 |
| Enzymes and minors | balance |
| Composition B | |
| LAS[1] | 23.00 |
| STPP[2] | 14.50 |
| Sodium carbonate | 17.50 |
| Sodium sulphate | 28.52 |
| Sodium silicate | 7.00 |
| Enzymes and minors | balance |

[1]$C_{12}$ - alkylbenzene sulphonate, sodium salt
[2]Sodium tripolyphosphate
[3]Tetra acetyl ethylene diamine, bleach activator

Experimental Procedures and Materials

Example 1

Evaluation Procedure

1. Pretreatment:

with the polymer (when present) at 200 mg/l in a washing solution at 2.1 g/l Composition A (Brazilian detergent powder), 5°TH 23° C., 20 minutes, 100 rpm, tergotometer rinse in 1 liter water 5 minutes drying on the drying drum (drum temperature is 95° C.; the swatches make ~3 turns over ~2 minutes; temperature of fabric taken off drum ~35° C.

2. Stain with 4 drops of dirty motor oil (DMO) diluted to 15% in toluene; dry at 40° C. for 1 hour 3. Wash with 2.1 g/l Composition A, 50°TH, 20 minutes at 23° C., rinse 5 minutes in 1 liter tap water, dry on the drying drum

Polymers

Two series of polyampholytes based on monomers of acrylic acid (AA) and quaternary methacrylamides MAPTAC or diQUAT were studied. The polymer characteristics are given in Tables 1–3, in which the following abbreviations are used for the constituent monomers:

TABLE 1
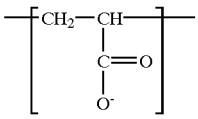
AA
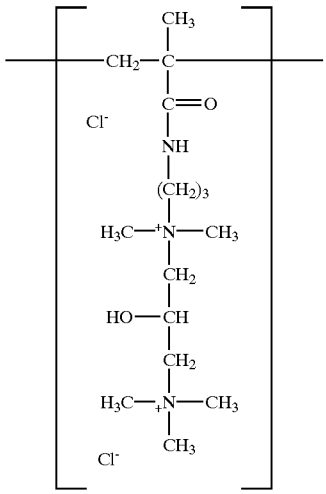
DIQUAT
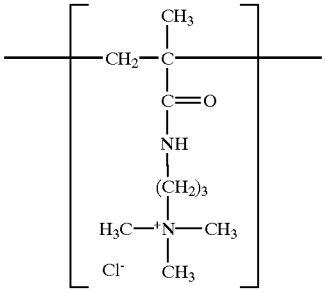
MAPTAC
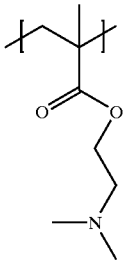
DMAEMA
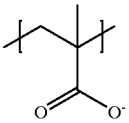
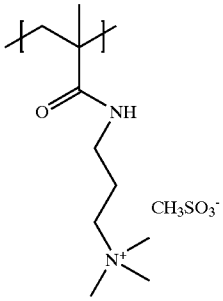
AA/MAPTAC polyampholytes
| Polymer Example | AA mole | MAPTAC mole | active/% | viscosity/cps |
|---|---|---|---|---|
| 1 | 50 | 50 | 20.6% | 36,000 |
| 2 | 70 | 30 | 20.1% | 46,500 |
| 3 | 90 | 10 | 15.2% | 36,000 |
| 4 | 95 | 5 | 15.1% | 25,000 |
TABLE 2
AA/DIQUAT polyampholytes
| Polymer Example | AA mole | DIQUAT mole | active/% | viscosity/cps |
|---|---|---|---|---|
| 5 | 80 | 20 | 17.1% | 37,250 |
| 6 | 67 | 33 | 20.3% | 6,150 |
TABLE 2-continued
AA/DIQUAT polyampholytes
| Polymer Example | AA mole | DIQUAT mole | active/% | viscosity/cps |
|---|---|---|---|---|
| 7 | 50 | 50 | 20.5% | 840 |

TABLE 3

| Ter-polymer DMAEMA/MA/MES | | | | |
|---|---|---|---|---|
| Polymer Example | DMAEMA mole | MA mole | MES mole | molecular weight |
| 8 | 40 | 30 | 30 | low |
| 9 | 40 | 40 | 20 | |
| 10 | 40 | 50 | 10 | |
| 11 | 40 | 30 | 30 | high |
| 12 | 40 | 40 | 20 | |
| 13 | 40 | 50 | 10 | |

Results

In the following tables, the polymer was added in the amount specified to the wash solution based on Formulation A, as specified above

TABLE 4

| AA/MAPTAC Polymers | | |
|---|---|---|
| Polymer Example | Amount mg/l | ΔR |
| — | — | 13.5 |
| 1 | 200 | 15.6 |
| 2 | 200 | 17.5 |
| 3 | 200 | 15.3 |
| 4 | 200 | 14.9 |

| AA/DIQUAT Polymers | | | | |
|---|---|---|---|---|
| Polymer Example | Amount mg/l | ΔR | Amount mg/l | ΔR |
| — | — | 13.1 | — | 13.1 |
| 5 | 100 | 17.7 | 200 | 17.5 |
| 6 | 100 | 9.5 | 200 | 8.2 |
| 7 | — | — | 200 | 7.1 |

TABLE 5

| Example 5 - Effect of Dosage | |
|---|---|
| Amount of Example 5 Polymer (mg/l) | ΔR |
| 0 | 13.0 |
| 20 | 16.2 |
| 40 | 16.4 |
| 60 | 18.4 |
| 80 | 17.9 |
| 100 | 18.3 |

TABLE 6

| DMAEMA/MAA/MES | | | | |
|---|---|---|---|---|
| Polymer Example | Amount mg/l | ΔR | Amount mg/l | ΔR |
| — | — | 13.4 | — | 13.4 |
| 11 | 100 | 15.3 | 200 | 18.7 |
| 12 | 100 | 16.6 | 200 | 19.5 |
| 13 | — | — | 200 | 14.7 |

Example 2

Evaluation Procedure

Conditions: tergotometer, 100 rpm, 23° C.

| | |
|---|---|
| 1. PRE-WASH: | 6 3" × 3" desized cotton squares, in 1 liter of wash liquor (liquor: cloth ca. 200:1)<br>wash liquor:<br><br>2.1 g of detergent (Composition B)<br>200 ppm of polymer<br>water: 1 liter water 12° FH<br>agitated for 20 mins<br>wash liquor decanted off |
| Rinse: | 1 liter of 12° FH water (as before)<br>Agitated for 5 mins |
| 2. STAINING: | dirty motor oil (DMO) diluted to 15 wt. %<br>4 drops of diluted DMO applied from a burette to each 3" × 3" square<br>Left to dry on racks in an oven (40° C.) for 1 hour |
| 3. MAIN WASH & rinse: | as pre-wash except polymer is at 50 ppm. |
| 4. ANALYSIS: | results are obtained by extracting R460 values (reflectance values at 460 nm) of the cloths<br>1. before staining ($R_{clean}$)<br>2. after staining ($R_{stain}$)<br>3. after final washing ($R_{washed}$)<br>delta (Δ) R is calculated for all samples including control (no polymer treatment):<br>$R_{washed} - R_{stain}$<br>ΔΔR is then calculated for quick comparison to the control<br>$\Delta R_{polymer} - \Delta R_{control}$ |

Polymers

Various polyampholytes were prepared and studied. The polymer compositions and test results are given in Table 7, in which the following abbreviations are used for the constituent monomers:

NEUTRAL MONOMERS

| Name | Structure |
|---|---|
| N-Vinylformamide (NVF) | 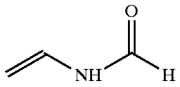 |
| t-Butylaminoethyl methacrylate (t-BuAEMA) | 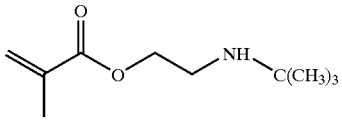 |
| Dimethylaminopropyl-methacrylamide (DMAPMA) | 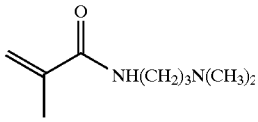 |
| Diethylaminoethyl Methacrylate (DEAEMA) | 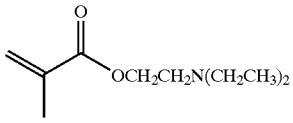 |

-continued

| Name | Structure |
|---|---|
| Dimethylaminoethyl Acrylate (DMAEA) | 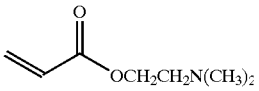 |
| N,N-dimethylacrylamide (DMA) | $(CH_3)NC(O)CH{=}CH_2$ |
| Vinyl acetate (VAc) | $CH_2{=}CHOC({=}O)CH_3$ |
| Hydroxylpropyl acrylate (HPA) | $HOCH_2CH_2CH_2OC({=}O)CH{=}CH_2$ |
| Hydroxylethyl acrylate (HEA) | $HOCH_2CH_2OC({=}O)CH{=}CH_2$ |
| Hydroxylethyl methacrylate (HEMA) | $HOCH_2CH_2OC({=}O)C(CH_3){=}CH_2$ |
| Ethylhexylacrylate (EHA) | 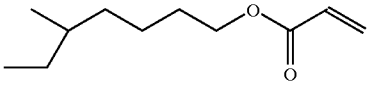 |

ANIONIC MONOMERS

| Name | Structure |
|---|---|
| Acrylic Acid (AA) | $CH_2{=}CHCO_2H$ |
| Methacrylic Acid (MAA) | $CH_2{=}C(CH_3)CO_2H$ |
| Acrylamidomethylpropanesulfonic acid (AMPS) | 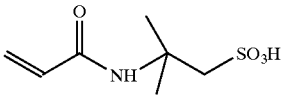 |

CATIONIC MONOMERS

| Name | Structure |
|---|---|
| Methacrylamido-propyl trimethylammonium chloride/ methylsulfate MAPTAC/MES | 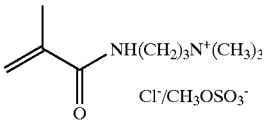 |
| Diquat | 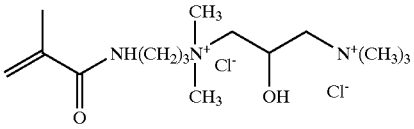 |

TABLE 7

| neutral (0) | anionic (−ve) | cationic (+ve) | % neutral | % anionic | % cationic | ΔΔR DMO |
|---|---|---|---|---|---|---|
| VP | AMPS | Diquat | 40 | 40 | 20 | 0.2 |
| V-Ac | AMPS | MAPTAC | 40 | 40 | 20 | 1.2 |
| t-BuAEMA | AMPS | MAPTAC | 40 | 40 | 20 | 0.9 |
| PEG2000-MA | MAA | MAPTAC | 30 | 46.7 | 23.3 | 1.9 |
| NVF | AMPS | MAPTAC | 40 | 40 | 20 | 1.1 |
| NVF | AMPS | Diquat | 44 | 44 | 11 | 1.6 |
| HPA | AMPS | MAPTAC | 40 | 40 | 20 | 2.8 |
| HPA | AA | MAPTAC | 40 | 40 | 20 | 2.6 |
| HPA | AMPS | Diquat | 44 | 44 | 11 | 4.1 |
| HPA | AA | Diquat | 44 | 44 | 11 | 0.2 |
| HEMA-10 DMAEMA | MAA | MES | 40 | 40 | 20 | 3.5 |
| HEA | AMPS | Diquat | 44 | 44 | 11 | 1.4 |
| HEA | AA | DADMAC | 40 | 40 | 20 | 3.0 |
| EHA | AA | MES | 24 | 61 | 15 | 0.1 |
| DMAPMA | AMPS | MAPTAC | 40 | 40 | 20 | 1.3 |
| DMAPMA | AA | MAPTAC | 20 | 60 | 20 | 0.4 |
| DMAPMA | MAA | MAPTAC | 20 | 60 | 20 | 0.1 |
| DMAPMA | AMPS | Diquat | 44 | 44 | 11 | 3.5 |
| DMAEMA | MAA | MES | 40 | 50 | 10 | 4.5 |
| DMAEMA | MAA | MES | 40 | 40 | 20 | 1.3 |
| DMAEMA | AMPS | MES | 40 | 30 | 30 | 0.9 |
| DMAEMA | AMPS | MES | 40 | 50 | 10 | 0.4 |
| DMAEMA | MAA | MAPTAC | 40 | 50 | 10 | 2.7 |
| DMAEMA | MAA | MAPTAC | 20 | 66.6 | 13.3 | 1.4 |
| DMAEMA | MAA | MAPTAC | 10 | 75 | 15 | 1.5 |
| DMAEMA | MAA | DADMAC | 20 | 73.3 | 6.7 | 1.5 |
| DMA | MAA | MAPTAC | 40 | 40 | 20 | 4.2 |
| DMA | AMPS | MAPTAC | 40 | 40 | 20 | 3.6 |
| DMA | AMPS | Diquat | 44 | 44 | 11 | 4.9 |
| DEAEMA | AMPS | MAPTAC | 40 | 40 | 20 | 0.7 |
| DEAEMA | AMPS | Diquat | 44 | 44 | 11 | 3.4 |
| — | MAA | DADMAC | 0 | 91.6 | 8.3 | 2.6 |

Example 3

| Washing-machine tests Evaluation procedure | |
|---|---|
| Conditions: | Brazilian "Brastemp" washing-machine<br>81 mins wash-time<br>41 liters intake volume<br>6° FH water<br>25° C.<br>2.1 g/l detergent formulation (composition B)<br>2 kg load weight |
| Pre-wash: | 4 pre-washes at 50 ppm polymer concentration |
| Main-wash: | single wash at 50 ppm polymer concentration |
| Staining | 5 stains used,<br>1. dirty motor oil (DMO), neat oil pipetted onto fabric<br>2. artificial sebum dyed with Macrolex B dye (obtained from Bayer), painted onto fabric whilst hot*. |

-continued 3. clay (50% wt suspension in water), brushed onto fabric
4. wine, pipetted neat onto fabric
5. tea, pipetted neat onto fabric
*The artificial sebum was prepared by adding the following ingredients in the ratios given, heating to 60° C. in a water bath and mixing until all the ingredients are combined:

Sebum:

| | |
|---|---|
| Fatty Acids (Prifac 9484) | 23.34% |
| Tripalmitin (C16:0) | 23.34% |
| Brominated Olive Oil | 23.34% |
| Squalene | 0.58% |
| Cholesterol | 4.92% |
| Ceto Stearyl Stearate (Estol 1481) | 14.42% |

Once all the sebum was liquid, 0.08 g of Macrolex B dye was added to 100 g of sebum and the mixture was stirred whilst hot until the dye had mixed thoroughly.

Results

| | | | | | | ΔΔR DMO | ΔΔR sebum | ΔΔR clay | ΔΔR wine | ΔΔR tea |
|---|---|---|---|---|---|---|---|---|---|---|
| On cotton | | | | | | | | | | |
| DMAEMA | MAA | MES | 40 | 40 | 20 | 0.1 | 3.5 | 2.2 | 1.3 | 0.4 |
| DMAEMA | MAA | MES | 40 | 50 | 10 | −0.2 | −0.8 | −0.4 | 0.8 | 0.2 |
| HEMA-10; MAEMA | MAA | MES | 10; 30 | 40 | 20 | 0.0 | 1.3 | −1.8 | 1.0 | 0.4 |
| DMAEMA | MAA | MAPTAC | 20 | 66.6 | 13.3 | 2.1 | 0.7 | −0.6 | 1.2 | 1.7 |
| DMAEMA | MAA | MAPTAC | 40 | 50 | 10 | 1.8 | 2.7 | 0.8 | 0.9 | 2.1 |
| On polyester-cotton | | | | | | | | | | |
| DMAEMA | MAA | MES | 40 | 40 | 20 | 2.5 | 0.7 | 1.4 | 0.8 | 0.9 |
| DMAEMA | MAA | MES | 40 | 50 | 10 | 4.7 | −0.5 | −0.5 | 0.3 | 1.0 |
| HEMA-10; MAEMA | MAA | MES | 10; 30 | 40 | 20 | 5.7 | 5.8 | 0.0 | 0.3 | 0.8 |
| DMAEMA | MAA | MAPTAC | 20 | 66.6 | 13.3 | 2.2 | 8.8 | 0.1 | 0.3 | 0.4 |
| DMAEMA | MAA | MAPTAC | 40 | 50 | 10 | 4.5 | 8.3 | 2.3 | 0.7 | 1.4 |

What is claimed is:

1. A composition for washing and/or rinsing of laundry, the composition comprising one or more surfactants suitable for use in laundry wash and/or rinsing product, an enzyme and enzyme and a polymer which is a co-polymer formed of:

(a) one or more anionic monomer units;

(b) one or more cationic monomer units; and (c) one or more uncharged monomer units;

wherein, the number ratio of the total of all negative charges on the anionic monomer unit(s) to the total of all positive charges on the cationic monomer unit(s) is from 10:1 to 3:1.

2. A composition according to claim 1, wherein the anionic monomer unit(s) is/are selected from those of formula (A)

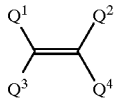

(A)

wherein at least two of $Q^1$–$Q^4$ are independently selected from hydrogen and methyl;

either one or two of $Q^1$–$Q^4$ are independently selected from anionic groups, of formula:

$Q^5Q^6Y$ wherein either or both of $Q^5$ and $Q^6$ is/are absent, $Q^5$ otherwise representing -Ph-, —CO—, —$CH_2$=$CH_2$, —CONH—or —CO—O— and $Q^6$ otherwise representing a $C_{1-4}$ alkylene linkage, one or more of the hydrogen atoms of which is independently optionally substituted by an —OH group or a group —Y;

Y is selected from groups of formula —$CO_2H$, —$SO_3H$, —$OSO_3H$, —$PO_4H$, —$PO_3H$, —$OPO_3H_2$ and —$O_PO_3H_3$;

and in the case where two only of $Q^1$–$Q^4$ are independently hydrogen or methyl and only one of $Q^1$–$Q^4$ is -$Q^5$–$Q^6$–Y, then the remaining group of $Q^1$–$Q^4$ can be any other compatible uncharged group.

3. A composition according to claim 1, wherein the anionic monomer unit(s) is/are independently selected from monomers having at least one anionic group selected from —$CO_2H$, —$SO_3H$, —$OSO_3H$, —$CH_2OSO_3H$, —CH=$CHSO_3H$ and groups of formula —$(CO)_p$—$CH_2$—$CQ^7Q^8CO_2H$, —$PO_4H$, —$PO_3H$, —$OPO_3H_2$, —$OPO_3H_3$, wherein p is 0 or 1, $Q^7$ is selected from H and OH and $Q^8$ is selected from H and $CO_2H$; and salts thereof.

4. A composition according to claim 1, wherein the anionic monomer units is/are selected from acrylic acid, methacrylic acid, α-ethacrylic acid, β,β-dimethylacrylic acid, methylenemalonic acid, vinylacetic acid, allylacetic acid, ethylideneacetic acid, propylideneacetic acid, crotonic acid, maleic acid or anhydride, fumaric acid, itaconic acid, citraconic acid, mesaconic acid, N-(methacryloyl)alanine, N-(acryloyl) -hydroxyglycine, sulphopropyl acrylate, sulphoethyl acrylate, sulphoethyl methacrylate, styrenesulphonic acid, vinylsulphonic acid, 2-sulphoethyl methacrylate, sodium allyloxy hydrooxypropyl sulphonate, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate, phophonopropyl methacrylate, ethyleneglycol methacrylate phophate, sulphate of alkoxylate (meth)acrylate, and the salts thereof.

5. A composition according to claim 1, wherein the cationic monomer unit(s) is/are independently selected from groups having one or more quaternary nitrogen atoms.

6. A composition according to claim 1, wherein the cationic monomer unit(s) is/are independently selected from one or more units derived from compounds of formulae (I) to (III):

(I)

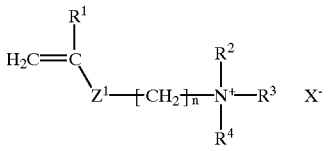

in which:

$R^1$ is a hydrogen atom or a methyl group;

$R^2$, $R^3$ and $R^4$ are linear or branched $C_1$–$C_6$ alkyl groups;

n is from 1 to 4;

$Z^1$ is a group —C(O)O, —C(O)NH— or —O—; and $X^-$ is a counterion compatible with the water-soluble nature of the polymer;

(II)

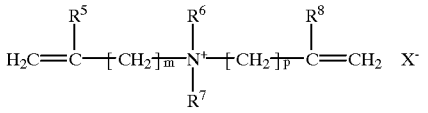

in which:

$R^5$ and $R^8$ are, independently hydrogen, or a linear or branched $C_1$–$C_6$ alkyl group;

$R^6$ and $R^7$ are independently represent alkyl, hydroxyalkyl or aminoalkyl group in which the alkyl group is a linear or branched $C_1$–$C_6$ chain;

m and p are independently from 1 to 3; and $X^-$ is as defined in formula (I); and (III)

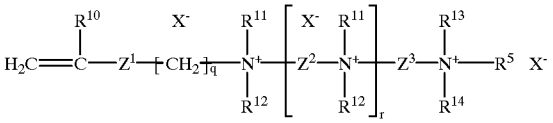

in which:

$R^9$ is hydrogen, methyl or ethyl;

$R^{10}$, $R^{11}$, $R^{12}$, $R^{13}$ and $R^{14}$ independently selected from groups as defined for $R^6$ and $R^7$ in formula(II);

q is from 0 to 10 r is from 0 to 6

$Z^1$ is as defined in formula (I);

$Z^2$ represents a $(CH_2)_S$ groups, being from 1 to 6;

$Z^3$ is a linear or branched $C_2$–$C_{12}$, polymethylene chain optionally interrupted by one or more heteroatoms or heterogroups, and optionally substituted by one or more hydroxyl or amino groups,; and $X^-$, is as defined in formula (I); and from those having a cyclic moiety with an $N^+$ atom.

7. A composition according to claim 1, comprising one or more uncharged monomer units in a mole ratio of the uncharged units relative to the total of all anionic monomer units plus the total of all cationic monomer units of from 1:1 to 1:99.

8. A composition according to claim 7, wherein the uncharged monomer unit(s) is/are selected from (i) hydrophilic neutral monomers (V)

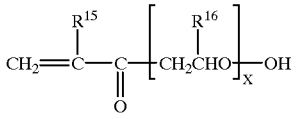

(ii) hydrophobic neutral monomers.

9. A laundry wash composition according to claim 1, wherein the surfactant(s) is/are selected from one or more anionic and/or nonionic surfactants.

10. A laundry wash composition according to claim 1, wherein the composition, when diluted in wash liquor, gives a pH of the wash liquor from 7 to 11.

11. A laundry rinse composition according to claim 1, wherein the surfactant(s) is are selected from one or more cationic rinse conditioner surfactants.

12. A process for effecting soil release from a laundry item, said process comprising contacting the laundry item with a polymer, said polymer being a copolymer formed of:

(a) one or more anionic monomer units;

(b) one or more cationic monomer units; and (c) optionally, one or more uncharged monomer units;

wherein, the number ratio of the total of all negative charges on the anionic monomer unit(s) to the total of all positive charges on the cationic monomer unit(s) is from 10:1 to 3:1.

13. A composition according to claim 1, wherein the number ratio of the total of all negative charges on the anionic monomer unit(s) to the total of all positive charges on the cationic monomer unit(s) is from 17:3 to 3:1.

14. A composition according to claim 6, wherein the cationic monomer unit(s) is/are independently selected from one or more units derived from compounds of formulae (I), in which:

$R^1$ is a methyl group;

$R^2$, $R^3$ and $R^4$ are linear or branched $C_1$–$C_6$ alkyl groups;

n is 3;

$Z^1$ is a group —C(O)O, —C(O)NH— or —O—; and $X^-$ is a counterion compatible with the water-soluble nature of the polymer, compounds of formula (II), in which:

$R^5$ and $R^8$ are, independently hydrogen, or a linear or branched $C_1$–$C_6$ alkyl group;

$R^6$ and $R^7$ are independently represent alkyl, hydroxyalkyl or aminoalkyl group in which the alkyl group is a methyl group;

m and p are independently from 1 to 3; and $X^-$ is as defined in formula (I); and compounds of formula (III), in which:

$R^9$ is hydrogen, methyl or ethyl;

$R^{10}$, $R^{11}$, $R^{12}$, $R^{13}$ and $R^{14}$ independently selected from groups as defined for $R^6$ and $R^7$ in formula(II);

q is from 0 to 2;

r is from 1 to 6;

$Z^1$ is as defined in formula (I);

$Z^2$ represents a $(CH_2)_s$ group, s being from 2 to 4;

$Z^3$ is a linear or branched $C_3$–$C_6$, polymethylene chain optionally interrupted by one or more 0 atom or NH group, and optionally substituted by one or more hydroxyl groups; and $X^-$ is as defined in formula (I);

and from those having a cyclic moiety with an $N^+$ atom.

15. A composition according to claim 7, wherein the mole ratio of the uncharged units relative to the total of all anionic monomer units plus the total of all cationic monomer units is from 3:2 to 1:9.

16. A process as claimed in claim 12, wherein, the number ratio of the total of all negative charges on the anionic monomer unit(s) to the total of all positive charges on the cationic monomer unit(s) is from 17:3 to 3:1.

* * * * *